US011343886B2

(12) United States Patent
Ding et al.

(10) Patent No.: US 11,343,886 B2
(45) Date of Patent: May 24, 2022

(54) CONTROLLER FOR LIGHT-EMITTING ELEMENT DRIVING DEVICE, DIMMING METHOD THEREOF AND LIGHT-EMITTING ELEMENT DRIVING DEVICE

(71) Applicant: Chengdu Monolithic Power Systems Co., Ltd., Chengdu (CN)

(72) Inventors: Huafei Ding, Hangzhou (CN); Changxian Zhong, Chengdu (CN)

(73) Assignee: Chengdu Monolithic Power Systems Co., Ltd., Chengdu (CN)

( * ) Notice: Subject to any disclaimer, the term of this patent is extended or adjusted under 35 U.S.C. 154(b) by 5 days.

(21) Appl. No.: 16/999,290

(22) Filed: Aug. 21, 2020

(65) Prior Publication Data

US 2021/0068220 A1 Mar. 4, 2021

(30) Foreign Application Priority Data

Aug. 30, 2019 (CN) ..... 201910821125.3

(51) Int. Cl.
*H05B 45/14* (2020.01)

(52) U.S. Cl.
CPC ..... *H05B 45/14* (2020.01)

(58) Field of Classification Search
CPC .... H05B 45/14; H05B 45/30; H05B 45/3577; H05B 47/10; H05B 47/105; H05B 47/165
See application file for complete search history.

(56) References Cited

U.S. PATENT DOCUMENTS

| | | | | |
|---|---|---|---|---|
| 8,896,214 | B2 | 11/2014 | Xu | |
| 8,901,851 | B2 | 12/2014 | Kuang et al. | |
| 9,013,120 | B2 | 4/2015 | Pierce et al. | |
| 9,179,519 | B2 | 11/2015 | Chen et al. | |
| 9,265,110 | B2 | 2/2016 | Yang | |
| 9,282,609 | B2 | 3/2016 | Kuang et al. | |
| 9,282,610 | B2 | 3/2016 | Kuang et al. | |
| 9,408,272 | B2 * | 8/2016 | Lian | H05B 45/3725 |
| 9,420,648 | B2 | 8/2016 | Feng et al. | |

(Continued)

FOREIGN PATENT DOCUMENTS

JP 2019033028 A * 2/2019 ..... H05B 45/10

OTHER PUBLICATIONS

U.S. Appl. No. 16/891,271, filed Jun. 3, 2020, Chengdu Monolithic Power Systems Co., Ltd.

*Primary Examiner* — Abdullah A Riyami
*Assistant Examiner* — Syed M Kaiser
(74) *Attorney, Agent, or Firm* — Perkins Coie LLP

(57) ABSTRACT

A light-emitting element driving device and controller and dimming method for the light-emitting element driving device. The light-emitting driving device has a dimming resistor and a power converter. A first current is provided to the dimming resistor, and a voltage across the dimming resistor is compared with a first threshold voltage. Then a second current is provided according to the comparison result. A dimming signal is generated based the voltage across the dimming resistor and a current flowing through the dimming resistor, to control the power converter to drive a plurality of light-emitting elements. A plurality of voltage windows may be configured for the dimming signal. a 2-step dimming function may be activated for high precision.

25 Claims, 8 Drawing Sheets

(56) References Cited

U.S. PATENT DOCUMENTS

2008/0054817 A1* 3/2008 Kao ..... H05B 41/3921
315/209 R
2013/0099694 A1* 4/2013 Naruo ..... H05B 45/327
315/224
2013/0278145 A1* 10/2013 Lin ..... H05B 45/10
315/122

* cited by examiner

CONTROLLER FOR LIGHT-EMITTING ELEMENT DRIVING DEVICE, DIMMING METHOD THEREOF AND LIGHT-EMITTING ELEMENT DRIVING DEVICE

CROSS-REFERENCE TO RELATED APPLICATION

This application claims priority to and the benefit of CN patent application No. 201910821125.3, filed on Aug. 30, 2019, which is incorporated herein by reference in its entirety.

TECHNICAL FIELD

The present invention generally relates to electronic circuits, and more particularly, relates to controller for light-emitting element driving device and dimming method thereof, and light-emitting element driving device.

BACKGROUND

Nowadays, LED (Light Emitting Diode) has become a main tendency in the development of lighting technology. In many product areas, it is required that the luminance of LEDs varies with the according scenarios of application, which means LED driving devices should support dimming function.

FIG. 1 schematically shows a conventional LED driving device 100 using a dimming method. A triangle signal $V_{TRI}$ is compared with a voltage signal $V_{SET}$ to generate a dimming signal PWM_D. When the dimming signal PWM_D is at high level, a power converter provides a driving current to the LEDs, and when the dimming signal PWM_D is at low level, the power converter ceases providing the driving current to the LEDs. Thus, by adjusting the voltage signal $V_{SET}$, a duty cycle of the dimming signal PWM_D is changed, so that an average current flowing through the LEDs is changed accordingly to achieve dimming of the LEDs.

However, since the triangle signal $V_{TRI}$ and the voltage signal $V_{SET}$ are likely to be affected by tolerance, offset and disturbance, the prior art shown in FIG. 1 can hardly satisfy a demand of high precision of dimming.

SUMMARY

The embodiments of the present invention are directed to a dimming method for a light-emitting element driving device to solve the aforementioned issue.

There has been provided, in accordance with an embodiment of the present invention, a dimming method for a light-emitting element driving device, wherein the light-emitting driving device comprises a dimming resistor configured for dimming depth and a power converter coupled to a plurality of light-emitting elements, the dimming method comprising: providing a first current to the dimming resistor; comparing a voltage across the dimming resistor with a first threshold voltage; providing a second current to the dimming resistor based on a comparison result of the voltage across the dimming resistor with the first threshold voltage; generating a dimming signal based on the voltage across the dimming resistor and a current flowing through the dimming resistor; and controlling the power converter based on the dimming signal to regulate an illuminance of the plurality of light-emitting elements.

There has been provided, in accordance with an embodiment of the present invention, a controller for a light-emitting element driving device, the controller comprising a first pin coupled to a dimming resistor, wherein: the controller provides a first current to the first pin, and compares a voltage at the first pin with a first threshold voltage; the controller provides a second current to the first pin based on a comparison result of the voltage at the first pin with the first threshold voltage; and the controller generates a dimming signal based on the voltage at the first pin and a current flowing through the first pin, and controls a power converter based on the dimming signal to regulate an illuminance of a plurality of light-emitting elements.

There has been provided, in accordance with an embodiment of the present invention, a light-emitting element driving device comprising a controller, the controller comprising a first pin coupled to a dimming resistor, wherein: the controller provides a first current to the first pin, and compares a voltage at the first pin with a first threshold voltage; the controller provides a second current to the first pin based on a comparison result of the voltage at the first pin with the first threshold voltage; and the controller generates a dimming signal based on the voltage at the first pin and a current flowing through the first pin, and controls a power converter for the light-emitting elements based on the dimming signal to regulate an illuminance of a plurality of the light-emitting elements.

BRIEF DESCRIPTION OF THE DRAWING

The present invention can be further understood with reference to the following detailed description and the appended drawings, wherein like elements are provided with like reference numerals.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail so as not to unnecessarily obscure aspects of the present invention.

Figure 1:
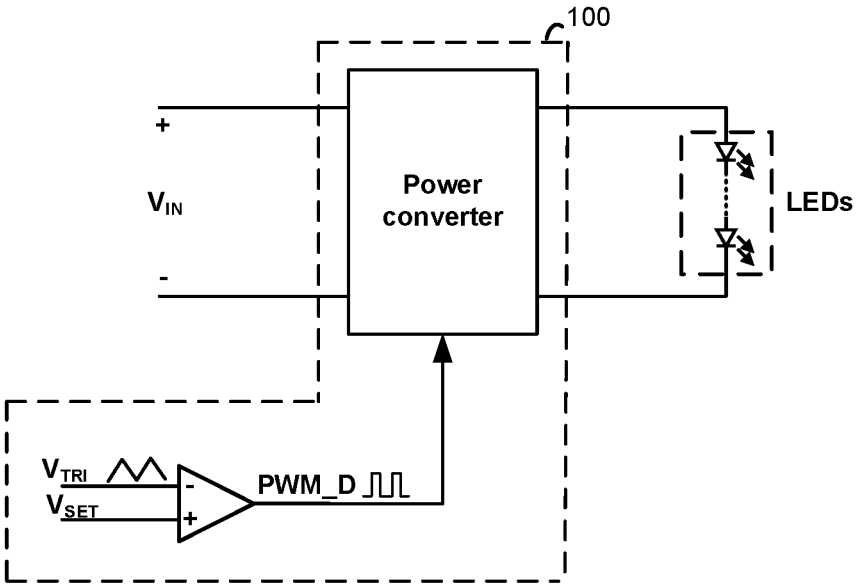
FIG. 1 (Prior Art)
FIG. 1 schematically shows a conventional LED driving device 100 using a dimming method.
Figure 2:
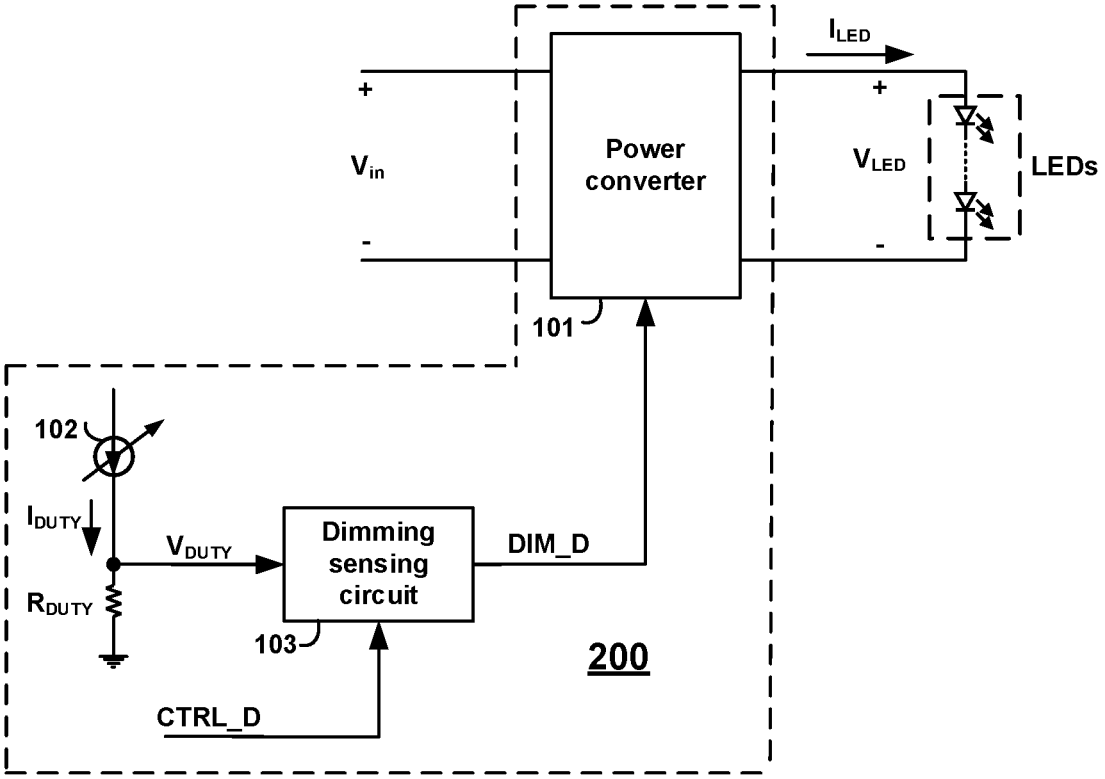
FIG. 2 schematically shows a LED driving device 200 in accordance with an embodiment of the present invention.

FIG. 2 schematically shows a LED driving device 200 in accordance with an embodiment of the present invention. The LED driving device 200 comprises a power converter 101, a variable current source 102, a dimming sensing circuit 103 and a dimming resistor $R_{DUTY}$. The power converter 101 is coupled between a power source and the LEDs to convert an input voltage $V_{IN}$ into a driving current for driving the LEDs. The power converter 101 may be implemented by any appropriate topology, such as BUCK, BOOST, BUCK-BOOST, FLYBACK, LDO and so on.

The dimming resistor $R_{DUTY}$ is configured to set a dimming depth, and a resistance of the dimming resistor $R_{DUTY}$ is generally adjusted by users according to the practical applications. The variable current source 102 is coupled to the dimming resistor $R_{DUTY}$ to provide a current $I_{DUTY}$. The current $I_{DUTY}$ may be changed to have different current levels. The dimming sensing circuit 103 is coupled to the dimming resistor $R_{DUTY}$, and a dimming signal DIM_D is generated by the dimming sensing circuit 103 based on a voltage $V_{DUTY}$ across the dimming resistor $R_{DUTY}$ and the current $I_{DUTY}$ provided to the dimming resistor $R_{DUTY}$, so as to control the power converter 101.

Step S116, controlling the power converter 101 based on the dimming signal DIM_D, so as to change a current $I_{LED}$ flowing through the LEDs to achieve LED dimming.

In some embodiments, when the dimming signal DIM_D is at a first state (eg. at high level), the power converter 101 provides a driving current for light-emitting elements. When the dimming signal DIM_D is at a second state (eg. at low level), the power converter 101 ceases to provide the driving current and the light-emitting elements stop giving out light. Thus, an average current flowing through the LEDs is in proportion to a duty cycle DD of the dimming signal DIM_D ("dimming duty cycle" for short), by changing the dimming duty cycle DD, the average current flowing through the LEDs is changed to achieve LED dimming.

The dimming sensing circuit 103 determines the dimming duty cycle DD based on the voltage $V_{DUTY}$ and the current $I_{DUTY}$. In some embodiments, as shown in the below table, the dimming sensing circuit 103 sets a plurality of voltage windows, each of the voltage windows has a respective voltage upper limit and a voltage lower limit. The dimming duty cycle DD is determined based on which voltage window the voltage $V_{DUTY}$ falls into and the present current level of the current $I_{DUTY}$. For example, when the current $I_{DUTY}$ has a current level $I_{DUTY1}$, and when the voltage $V_{DUTY}$ falls into voltage window 1, i.e. $V_{DUTY_L1}<V_{DUTY}<V_{DUTY_H1}$, the dimming duty cycle DD is $X_{N+1}$%. When the current $I_{DUTY}$ has a current level $I_{DUTY2}$, and when the voltage $V_{DUTY}$ falls into voltage window 1, the dimming duty cycle DD is $X_1$%. Therefore, as long as the resistance of the dimming resistor $R_{DUTY}$ is properly selected to make the voltage $V_{DUTY}$ is in a targeted voltage window, a respective value of the dimming duty cycle DD is obtained.

TABLE 1

| | voltage windows of $V_{DUTY}$ | | dimming duty cycle DD | |
|---|---|---|---|---|
| | upper limit | lower limit | if $I_{DUTY} = I_{DUTY1}$ | if $I_{DUTY} = I_{DUTY2}$ |
| voltage window N | $V_{DUTY_HN}$ | $V_{DUTY_LN}$ | $X_{2N}$ % | $X_N$ % |
| voltage window N − 1 | $V_{DUTY_H(N-1)}$ | $V_{DUTY_L(N-1)}$ | $X_{2N-1}$ % | $X_{(N-1)}$ % |
| . . . | . . . | . . . | . . . | . . . |
| voltage window 2 | $V_{DUTY_H2}$ | $V_{DUTY_L2}$ | $X_{N+2}$ % | $X_2$ % |
| voltage window 1 | $V_{DUTY_H1}$ | $V_{DUTY_L1}$ | $X_{N+1}$ % | $X_1$ % |

Figure 3:
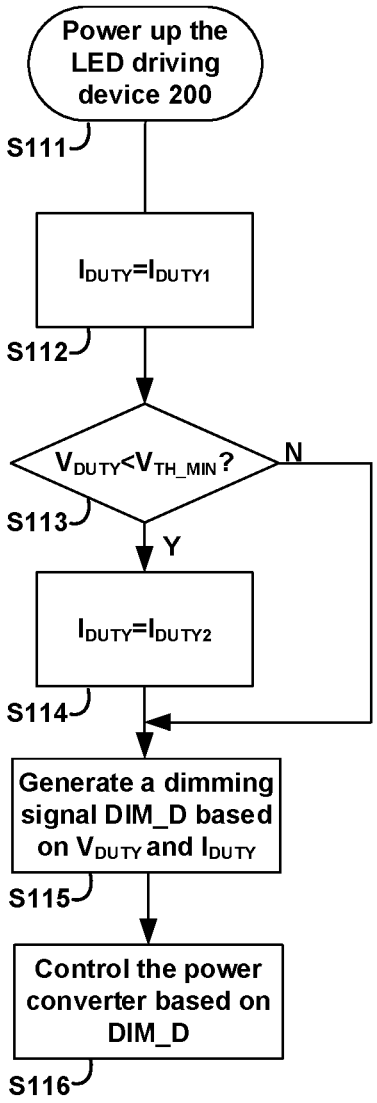
FIG. 3 shows a flow chart of a dimming method for the LED driving device 200 shown in FIG. 2 in accordance with an embodiment of the present invention.

FIG. 3 shows a flow chart of a dimming method for the LED driving device 200 shown in FIG. 2, comprising steps S111-S116.

Step S111, powering up the LED driving device 200.

Step S112, providing the current $I_{DUTY}$ to have a current level $I_{DUTY1}$ by the variable current source 102 to the dimming resistor $R_{DUTY}$.

Step S113, comparing the voltage $V_{DUTY}$ across the dimming resistor $R_{DUTY}$ with a lower threshold voltage $V_{TH_MIN}$. Turns to step S114 if the voltage $V_{DUTY}$ is smaller than the lower threshold voltage $V_{TH_MIN}$, otherwise turns to step S115.

Step S114, providing the current $I_{DUTY}$ to have a current level $I_{DUTY2}$ by the variable current source 102 to the dimming resistor $R_{DUTY}$, wherein the current level $I_{DUTY2}$ is greater than the current level $I_{DUTY1}$.

Step S115, generating the dimming signal DIM_D based on a voltage $V_{DUTY}$ across the dimming resistor $R_{DUTY}$ and providing the current $I_{DUTY}$ to the dimming resistor $R_{DUTY}$.

In some embodiments, the LED driving device further receives a dimming control signal CTRL_D. The dimming control signal CTRL_D is provided to the dimming sensing circuit 103. If the dimming control signal CTRL_D is at a first state (e.g. at high level), the dimming duty cycle DD is configured as 100%, the power converter 101 continuously provides the driving current. If the dimming control signal CTRL_D is at a second state (e.g. at low level), then the dimming duty cycle is configured to be determined based on the voltage $V_{DUTY}$ and the current $I_{DUTY}$, for example, based on the above table 1. Such a dimming function is referred to as 2-step dimming.

Figure 4:
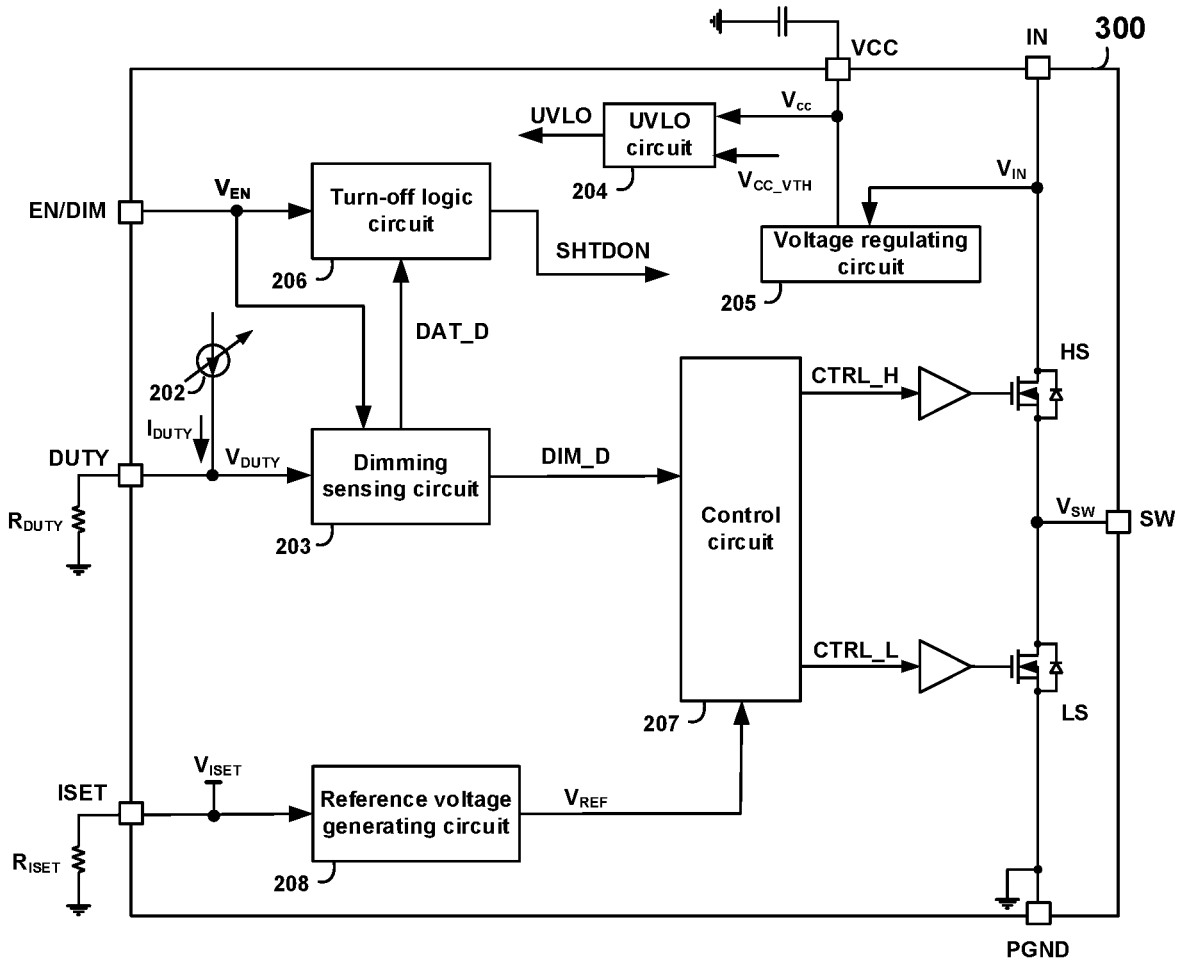
FIG. 4 schematically shows a block diagram of a controller 300 for a LED driving device in accordance with an embodiment of the present invention.

FIG. 4 schematically shows a block diagram of a controller 300 for a LED driving device in accordance with an embodiment of the present invention. The controller 300 comprises transistors HS and LS, a variable current source 202, a dimming sensing circuit 203, a UVLO (Under-Voltage Lock Out) circuit 204, a voltage regulating circuit 205, a turn-off logic circuit 206, a control circuit 207 and multiple pins. A pin IN is configured to receive the input voltage $V_{IN}$, and a pin PGND is configured to be coupled to a ground reference. The transistors HS and LS is coupled in series between the pins IN and PGND, and a connection node of the transistors HS and LS is coupled to a pin SW. The transistors HS and LS and external components such as capacitors or inductors that are coupled to the pin SW, constitute a power converter that provides driving current to the LEDs.

A pin VCC is coupled to a capacitor externally. The voltage regulating circuit 205 is coupled between the pin IN and the pin VCC, and generates a supply voltage $V_{CC}$ at the pin VCC based on the input voltage $V_{IN}$ to supply most circuits in the controller 300. The UVLO circuit 204 is coupled to the pin VCC, and generates a signal UVLO by comparing the supply voltage $V_{CC}$ with a supply limiting voltage $V_{CC_VTH}$ in hysteresis. The UVLO circuit 204 is configured to ensure that the controller 300 is under protection when the supply voltage $V_{CC}$ is below normal value.

A pin DUTY is configured to be coupled to the dimming resistor $R_{DUTY}$ externally. The variable current source 202 is coupled to the pin DUTY to provide the current $I_{DUTY}$. The dimming sensing circuit 203 is coupled to the pin DUTY to receive the voltage $V_{DUTY}$ at the pin, and generates the dimming signal DIM_D based on the voltage $V_{DUTY}$ and the current $I_{DUTY}$. The control circuit 207 is coupled to the dimming sensing circuit 203, and generates control signals CTRL_H and CTRL_L based on the dimming signal DIM_D, so as to control the transistors HS and LS.

In some embodiments, when the dimming signal DIM_D is at high level, the control circuit 207 generates the control signals CTRL_H and CTRL_L based on a reference voltage $V_{REF}$ and a feedback signal indicative of the current flowing through the LEDs. The transistors HS and LS are alternatively switched on and off, so as to convert the input voltage $V_{IN}$ into a driving current corresponding to the reference voltage $V_{REF}$ and provided to the LEDs. The control circuit 207 may adopt any appropriate control method, such as fixed-frequency peak current control, hysteresis control, constant-on-time control and so on. The reference voltage $V_{REF}$ may be predetermined, or may be adjusted by users according to practical requirements. In the example of FIG. 4, the controller 300 further comprises a pin ISET coupled to an external resistor $R_{ISET}$ and a reference voltage generating circuit 208 coupled to the pin ISET. A voltage $V_{ISET}$ is provided to the pin ISET, and the reference voltage generating circuit 208 generates the reference voltage $V_{REF}$ based on a current flowing through the pin ISET. In some embodiments, the reference voltage $V_{REF}$ varies with changes of the input voltage $V_{IN}$ and temperature of the controller 300.

When the dimming signal DIM_D is at high level, the control circuit 207 turns off both the transistors HS and LS, so transfer of energy is stopped from the input voltage $V_{IN}$ to the LEDs, and the current flowing through the LEDs will then turn to zero.

A pin EN/DIM is a multi-functional pin, when the 2-step dimming function is activated, this pin is used for the 2-step dimming control, while when the 2-step dimming function is deactivated, this pin is directly used for dimming. In one embodiment, the dimming sensing circuit 203 determines whether the 2-step dimming function is activated or deactivated (for example, based on the voltage $V_{DUTY}$ or other signals), and generates an indicating signal DAT_D. The turn-off logic circuit 206 is coupled to the pin EN/DIM and receives the indicating signal DAT_D. When the 2-step dimming function is activated, a multi-functional signal $V_{EN}$ received at the pin EN/DIM is used for 2-step dimming control. Under this circumstance, if the multi-functional signal $V_{EN}$ is at a first state (e.g. at high level), the dimming duty cycle DD is configured as 100%, if the multi-functional signal $V_{EN}$ is at a second state (e.g. at low level), the dimming duty cycle DD is determined based on the voltage $V_{DUTY}$ and the current $I_{DUTY}$. When the 2-step dimming function is deactivated, if the multi-functional signal $V_{EN}$ is at a first state (e.g. at high level), the power converter provides the driving current to the LEDs, if the multi-functional signal $V_{EN}$ is at a second state (e.g. at low level), the power converter ceases providing the driving current to the LEDs. When the 2-step dimming function is deactivated, if the time interval during which the multi-functional signal $V_{EN}$ is at the second state is longer than a predetermined threshold time, then the turn-off logic circuit generates a signal SHTDON to shut down the controller 300.

Figure 5:
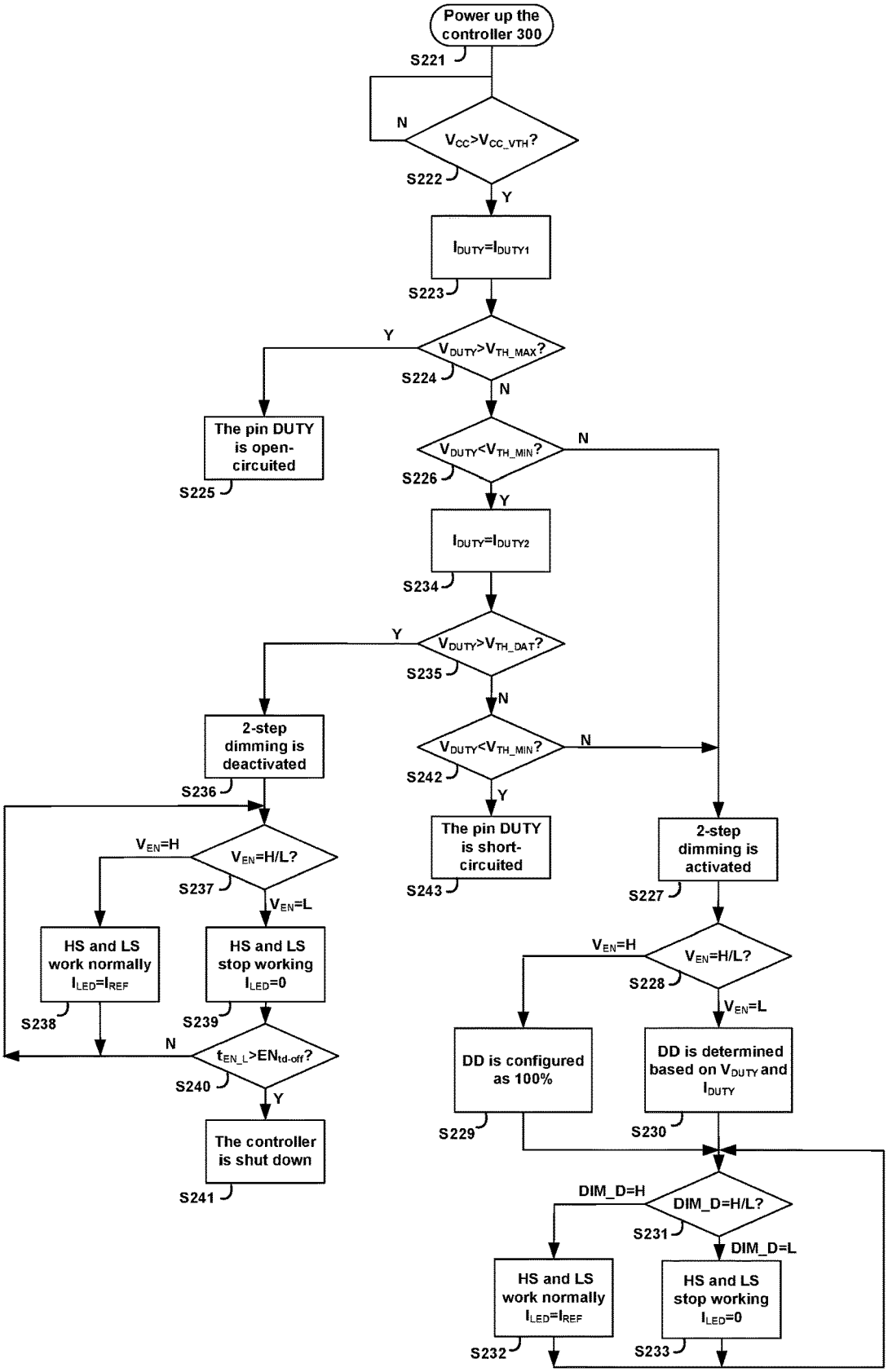
FIG. 5 shows a flow diagram of the working process of the controller 300 shown in FIG. 4 in accordance with an embodiment of the present invention.

Below is a more detailed description to the working principles of the controller 300 in FIG. 4 with the illustration of FIG. 5. FIG. 5 shows a flow diagram of the working process of the controller 300 shown in FIG. 4 in accordance with an embodiment of the present invention, the flow diagram comprises steps S221-S241.

Step S221, powering up the controller 300. With the operation of the voltage regulating circuit 205, the supply voltage $V_{CC}$ is gradually increasing.

Step S222, determining whether the supply voltage $V_{CC}$ is greater than the supply limiting voltage $V_{CC_VTH}$ (e.g. 4.7V). If the supply voltage $V_{CC}$ is greater than the supply limiting voltage $V_{CC_VTH}$, turn to step S223. Otherwise, let the supply voltage $V_{CC}$ continue increasing.

Step S223, providing the current having the current level $I_{DUTY1}$ (e.g. 45 uA) by the variable current source 202 to the pin DUTY.

Step S224, comparing the voltage $V_{DUTY}$ with an upper threshold voltage $V_{TH_MAX}$ (e.g. 3.347V). If the voltage $V_{DUTY}$ is greater than the upper threshold voltage $V_{TH_MAX}$, turn to step S225. Otherwise, turn to step S226.

Step S225, determining that the pin DUTY is open-circuited, and taking a corresponding action of open-circuited protection.

Step S226, comparing the voltage $V_{DUTY}$ with the lower threshold voltage $V_{TH_MIN}$ (e.g. 0.279V). If the voltage $V_{DUTY}$ is smaller than the lower threshold voltage $V_{TH_MIN}$, turn to step S234. Otherwise, turn to step S227.

Step S227, determining that the 2-step dimming function is activated, and using the multi-functional signal $V_{EN}$ at the pin EN/DIM for 2-step dimming control.

Step S228, determining whether the multi-functional signal $V_{EN}$ is high level or low level. If the multi-functional signal $V_{EN}$ is high level (for example, higher than 1.67V), turn to step S229. If the multi-functional signal $V_{EN}$ is low level (for example, lower than 1.58V), turn to step S230.

Step S229, setting the dimming duty cycle DD as 100%.

Step S230, adjusting the dimming duty cycle DD based on the voltage $V_{DUTY}$ and the current $I_{DUTY}$.

Step S231, determining whether the dimming signal DIM_D is high level or low level. If the dimming signal DIM_D is high level, turn to step S232. If the dimming signal DIM_D is low level, turn to step S233.

Step S232, operating the control circuit 207 normally and alternatively turning on and off the transistors HS and LS, so as to convert the input voltage $V_{IN}$ into a current $I_{REF}$ corresponding to the reference voltage $V_{REF}$ and provided to the LEDs.

Step S233, turning off both the transistors HS and LS by the control circuit 207, so that the current $I_{LED}$ flowing through the LEDs decreases to zero.

Step S234, providing the current having the current level $I_{DUTY2}$ (e.g. 600 uA) by the variable current source 202.

Step S235, comparing the voltage $V_{DUTY}$ with a deactivating threshold voltage $V_{TH_DAT}$ (e.g. 2.235V). If the voltage $V_{DUTY}$ is greater than the deactivating threshold voltage $V_{TH_DAT}$, turn to step S236. Otherwise, turn to step S242. In some embodiments, the deactivating threshold voltage $V_{TH_DAT}$ may be configured as equal with the upper threshold voltage $V_{TH_MAX}$.

Step S236, determining that the 2-step dimming function is deactivated, and using the multi-functional signal $V_{EN}$ directly for LED dimming.

Step S237, determining whether the multi-functional signal $V_{EN}$ is high level or low level. If the multi-functional signal $V_{EN}$ is high level, turn to step S238. If the multi-functional signal $V_{EN}$ is low level, turn to step S239.

Step S238, operating the control circuit 207 normally and alternatively turning on and off the transistors HS and LS, so as to convert the input voltage $V_{IN}$ into a current $I_{REF}$ corresponding to the reference voltage $V_{REF}$ and provided to the LEDs.

Step S239, turning off both the transistors HS and LS by the control circuit 207, so that the current $I_{LED}$ flowing through the LEDs decreases to zero.

Step S240, determining whether a time interval $t_{EN_L}$ of the multi-functional signal $V_{EN}$ being at low level is longer than a threshold time $EN_{td\text{-}off}$ (e.g. 10 mS). If the time interval $t_{EN_L}$ is longer than the threshold time $EN_{td\text{-}off}$, turn to step S241 to shutdown the controller.

Step S242, comparing the voltage $V_{DUTY}$ with the lower threshold voltage $V_{TH_MIN}$ again. If the voltage $V_{DUTY}$ is smaller than the lower threshold voltage $V_{TH_MIN}$, turn to step S243. Otherwise, turn to step S227.

Step S243, determining that the pin DUTY is short-circuited and taking a corresponding action of short-circuited protection (e.g. turning off both the transistors HS and LS, or shutting down the controller).

Figure 6A:
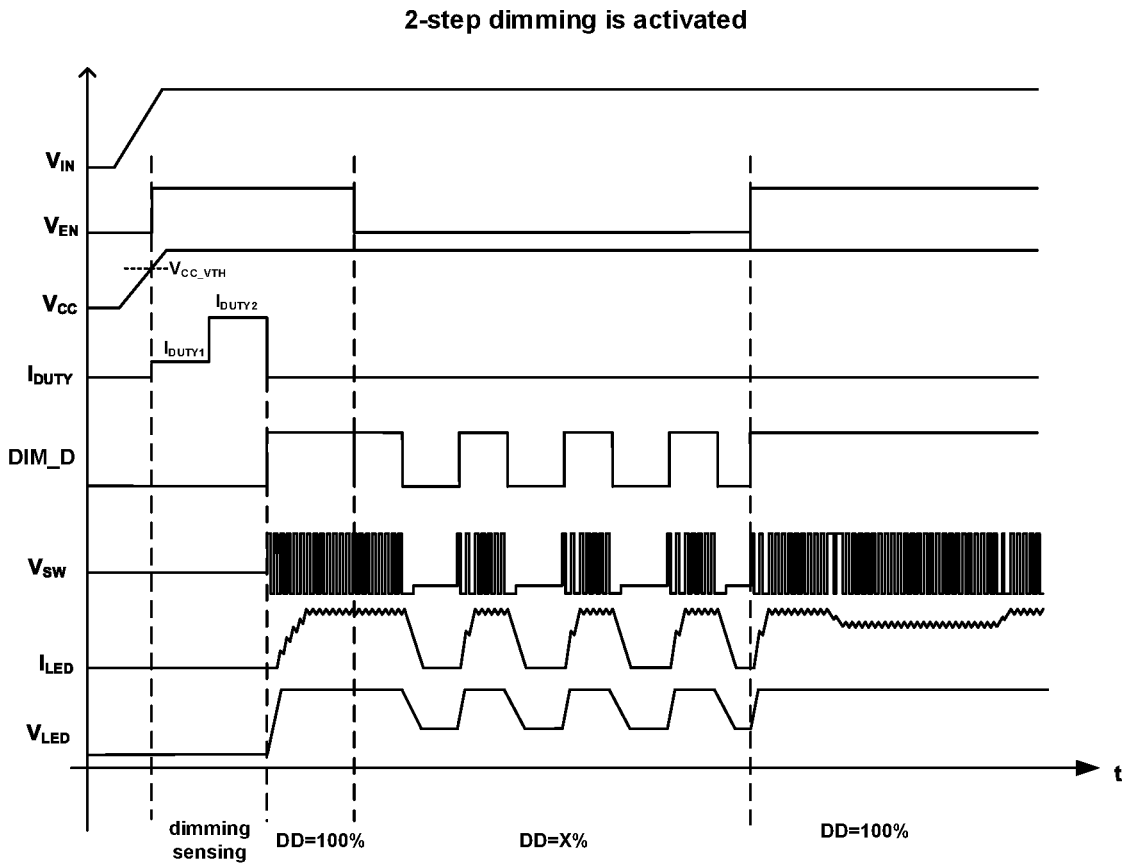
FIG. 6A shows waveforms of the controller in FIG. 4 when the 2-step dimming function is activated in accordance with an embodiment of the present invention.

FIG. 6A shows waveforms of the controller 300 in FIG. 4 when the 2-step dimming function is activated in accordance with an embodiment of the present invention. After dimming sensing is completed, if the multi-functional signal $V_{EN}$ is at high level, the dimming duty cycle DD is 100%. If the multi-functional signal $V_{EN}$ is at low level, the dimming duty cycle DD is configured as X % based on the voltage $V_{DUTY}$ and the current $I_{DUTY}$.

Figure 6B:
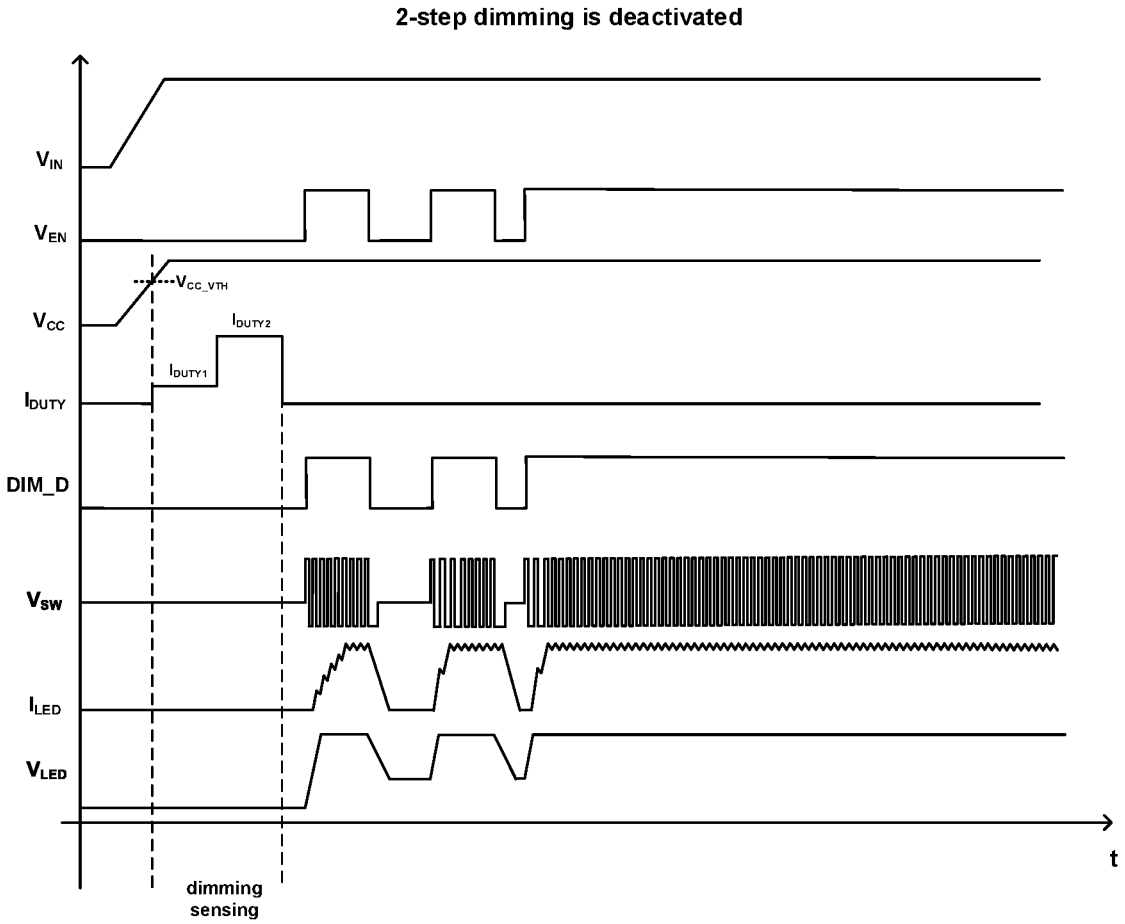
FIG. 6B shows waveforms of the controller in FIG. 4 when the 2-step dimming function is deactivated in accordance with an embodiment of the present invention.

FIG. 6B shows waveforms of the controller 300 in FIG. 4 when the 2-step dimming function is deactivated in accordance with an embodiment of the present invention. After dimming sensing is completed, if the multi-functional signal $V_{EN}$ is at high level, the LEDs are luminous. If the multi-functional signal $V_{EN}$ is at low level, the LEDs stop giving out light.

It should be noted that the controller 300 may further need to carry out other actions of sensing and parameter setting after the dimming sensing in practical applications. After all of these actions have been accomplished, the transistors HS and LS are allowed to be turned on and off.

Figure 7:
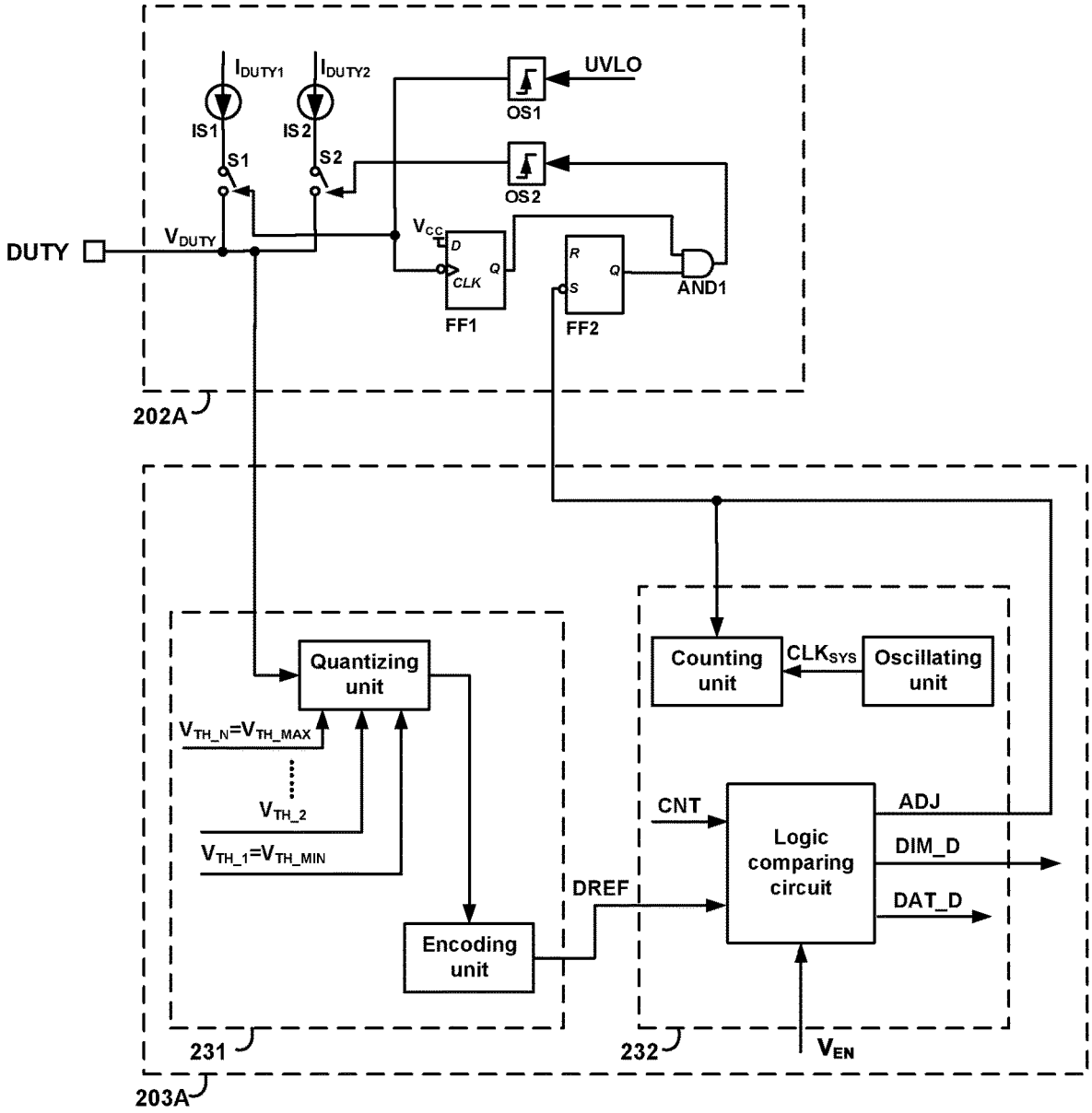
FIG. 7 schematically shows circuit structure of the variable current source and the dimming sensing circuit in the controller 300 in FIG. 4 in accordance with an embodiment of the present invention.

FIG. 7 schematically shows circuit structure of the variable current source and the dimming sensing circuit in the controller 300 in FIG. 4 in accordance with an embodiment of the present invention. A variable current source 202A comprises current sources IS1, IS2, switching transistors S1, S2, one-shot circuits OS1, OS2, flip-flops FF1, FF2 and an AND gate AND1. A dimming sensing circuit 203A comprises an analog-to-digital unit 231 and a PWM generating unit 232. The specific connections are shown in FIG. 7.

After the controller is powered up, the supply voltage $V_{CC}$ increases to be greater than the supply limiting voltage $V_{CC_VTH}$. The signal UVLO steps to high level from low level, and then the one-shot circuit OS1 generates a pulse with a predetermined width to keep the switching transistor S1 turned-on for a certain time, during which the current source IS1 provides a current having the current level $I_{DUTY1}$ to the pin DUTY.

A signal ADJ is provided by the dimming sensing circuit 203A, and is configured to indicate whether the voltage $V_{DUTY}$ is smaller than the lower threshold voltage $V_{TH_MIN}$ with the current having the current level $I_{DUTY1}$ provided. If the voltage $V_{DUTY}$ is smaller than the lower threshold voltage $V_{TH_MIN}$, the signal ADJ is at low level, the flip-flop FF2 is set to generate a pulse. Following that, at a falling edge of the pulse generated by the one-shot circuit OS1, the flip-flop FF1 is set to generate a pulse. Then, a signal at an output terminal of the AND gate AND1 steps to high level from low level, so the one-shot circuit OS2 generates a pulse with a predetermined width to keep the switching transistor S2 turned-on for a certain time, during which the current source IS2 provides a current having the current level $I_{DUTY2}$ to the pin DUTY.

The analog-to-digital unit 231 generates a digital threshold signal DREF based on the voltage $V_{DUTY}$. In some embodiments, the analog-to-digital unit 231 comprises a quantizing unit and an encoding unit. The quantizing unit compares the voltage $V_{DUTY}$ with threshold voltages $V_{TH_1}$~$V_{TH_N}$, the encoding unit generates the digital threshold signal DREF provided to the PWM generating unit 232. The threshold voltages $V_{TH_1}$~$V_{TH_N}$ are different with each other and in increasing order, to form the aforementioned voltage windows. In some embodiments, the threshold voltage $V_{TH_1}$ is equal with $V_{TH_MIN}$, and the threshold voltage $V_{TH_N}$ is equal with $V_{TH_MAX}$.

The PWM generating unit 232 receives the digital threshold signal DREF and the multi-functional signal $V_{EN}$, and generates the dimming signal DIM_D, the signal ADJ and the indicating signal DAT_D based thereon. In some embodiments, the PWM generating unit 232 comprises an oscillating unit, a counting unit and a logic comparing unit. The oscillating unit generates a clock signal $CLK_{SYS}$. The counting unit generates a periodic digital counting signal CNT based on the clock signal $CLK_{SYS}$. The frequency of the dimming signal DIM_D is determined by the frequency of the digital counting signal CNT, which may be predetermined (e.g. 500 Hz), or be set by users. The frequency of the clock signal $CLK_{SYS}$ (e.g. 50 kHz) is much higher than the frequency of the digital counting signal CNT. The logic comparing unit generates the dimming signal DIM_D, the signal ADJ and the indicating signal DAT_D based on the digital threshold signal DREF, the digital counting signal CNT and the multi-functional signal $V_{EN}$. When the 2-step dimming function is activated and the multi-functional signal $V_{EN}$ is at low level, the logic comparing unit compares the digital threshold signal DREF with the digital counting signal CNT to generate the dimming signal DIM_D. The PWM generating unit 232 may adopt other appropriate means such as look-up table, and these transformations do not distract from the scope of the invention.

Table 2 shows the relationship between the dimming duty cycle DD and the voltage $V_{DUTY}$ and the current $I_{DUTY}$ in accordance with an embodiment of the present invention.

TABLE 2

| | voltage windows of $V_{DUTY}$ | | dimming duty cycle DD | |
|---|---|---|---|---|
| | upper limit (V) | lower limit (V) | if $I_{DUTY1}$ = 45 uA | if $I_{DUTY2}$ = 600 uA |
| voltage window 7 | 4.100 | 3.347 | open-circuited protection | 2-step dimming is deactivated |
| voltage window 6 | 3.347 | 2.235 | 15% | |
| voltage window 5 | 2.235 | 1.489 | 14% | 9% |
| voltage window 4 | 1.489 | 0.989 | 13% | 8% |
| voltage window 3 | 0.989 | 0.653 | 12% | 7% |
| voltage window 2 | 0.653 | 0.428 | 11% | 6% |
| voltage window 1 | 0.428 | 0.279 | 10% | 5% |
| | 0.279 | | change to $I_{DUTY2}$ | short-circuited protection |

In the example of Table 2, even if there exists tolerance in the variable current source 102, the dimming resistor $R_{DUTY}$ and the upper limits and the lower limits of each voltage window, as long as the resistance of the dimming resistor $R_{DUTY}$ is appropriately selected (as shown in Table 3) to make sure that the voltage $V_{DUTY}$ falls into a corresponding voltage window, the dimming duty cycle DD is accurately obtained.

TABLE 3

| dimming duty cycle DD | $R_{DUTY}$ (Ω) |
|---|---|
| 15% | 61900 |
| 14% | 41200 |
| 13% | 27400 |
| 12% | 18200 |
| 11% | 12100 |
| 10% | 7870 |
| 2-step dimming is deactivated | 4870 |
| 9% | 3090 |
| 8% | 2050 |
| 7% | 1370 |
| 6% | 887 |
| 5% | 576 |

Figure 8:
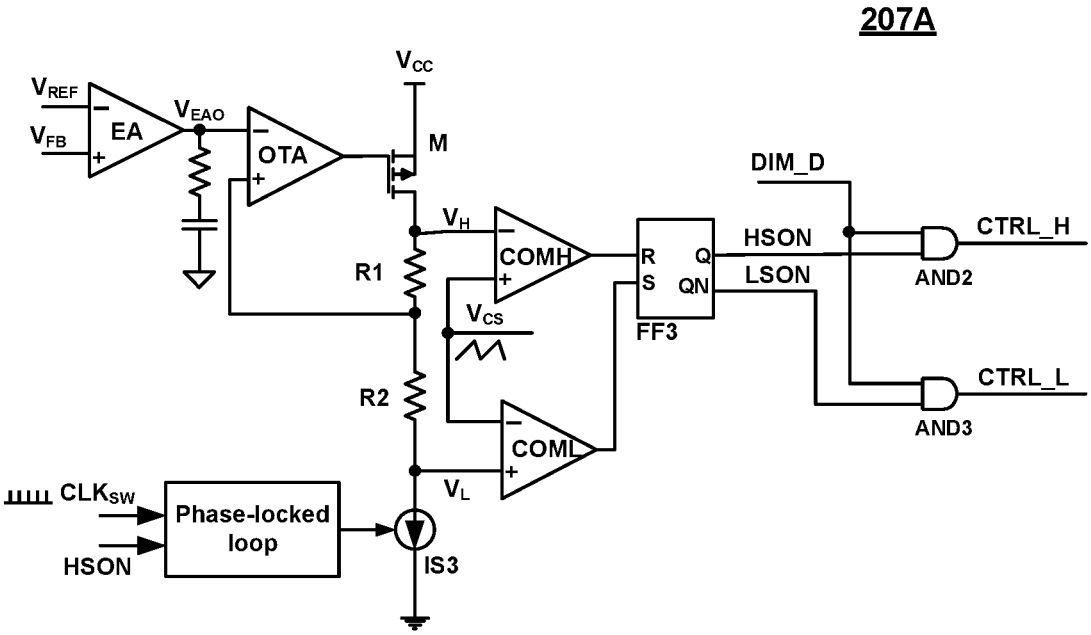
FIG. 8 schematically shows a control circuit 207A in accordance with an embodiment of the present invention.

FIG. 8 schematically shows a control circuit 207A in accordance with an embodiment of the present invention. The control circuit 207A comprises an error amplifier EA, an operational amplifier OTA, a transistor M, comparators COMH and COML, resistors R1 and R2, a current source IS3, a flip-flop FF3, AND gates AND2 and AND3 and a phase-locked loop, and the connections are shown in FIG. 8.

The error amplifier EA has a first input terminal receiving the reference voltage $V_{REF}$, a second input terminal receiving a feedback voltage VFB indicative of the current flowing through the LEDs and an output terminal providing an error amplified signal $V_{EAO}$. The operational amplifier OTA has a first input receiving the error amplified signal $V_{EAO}$, a second input terminal coupled to a connection node of resistors R1 and R2, and an output terminal coupled to a control terminal of the transistor M.

The transistor M, resistors R1 and R2, the current source IS3 are seriously coupled between the supply voltage VCC and the ground reference. An upper limit hysteresis signal VH is provided at a connection node of the transistor M and the resistor R1, and a lower limit hysteresis signal VL is provided at a connection node of the resistor R2 and the current source IS3. The phase-locked loop has a first input terminal receiving a reference clock signal $CLK_{SW}$, a second input terminal receiving a signal HSON. The phase-locked loop controls the current source IS3 based on a phase differential between the reference clock signal $CLK_{SW}$ and the signal HSON.

The comparator COMH has a first input terminal receiving the upper limit hysteresis signal VH, a second input terminal receiving a current sensing signal $V_{CS}$ indicative of a current flowing from the pin SW of the controller, and an output terminal. Similarly, the comparator COML has a first input terminal receiving the lower limit hysteresis signal VL, a second input terminal receiving the current sensing signal $V_{CS}$, and an output terminal. The flip-flop FF3 has a first input terminal R coupled to the output terminal of the comparator COMH, a second input terminal S coupled to the output terminal of the comparator COML, a first output terminal Q providing the signal HSON and a second output terminal QN providing a signal LSON.

The AND gate AND2 receives the dimming signal DIM_D and the signal HSON to generate the control signal CTRL_H. The AND gate AND3 receives the dimming signal DIM_D and the signal LSON to generate the control signal CTRL_L. When the dimming signal DIM_D is at low level, the control signals CTRL_H and CTRL_L are both at low level, turning off both the transistors HS and LS. When the dimming signal DIM_D is at high level, the control signals CTRL_H and CTRL_L are respectively equal with the signals HSON and LSON.

In the aforementioned embodiments, the dimming signal DIM_D is often used for PWM dimming. However, persons of ordinary skills in the art will recognize, that the dimming signal DIM_D could be used to regulate or generate the reference voltage $V_{REF}$, namely used for analog dimming. Besides, the load of LED may be a single LED, or be a series-parallel array of LEDs. Also, the driving device of the invention may drive any other appropriate light-emitting element.

In some embodiments, beside the current levels $I_{DUTY1}$ and $I_{DUTY2}$, the current provided to the dimming resistor $R_{DUTY}$ may change to more current levels according to the requirements of dimming depth and dimming accuracy. For example, if the voltage $V_{DUTY}$ is smaller than the lower limit threshold voltage $V_{TH_MIN}$ with the current level $I_{DUTY2}$ provided, then a current having a current level $I_{DUTY3}$ is provided to the dimming resistor $R_{DUTY}$, and the current level $I_{DUTY3}$ is greater than the current level $I_{DUTY2}$. Similarly, more current levels $I_{DUTY4}$, $I_{DUTY5}$ may be configured. In addition, in the aforementioned embodiments, the current level $I_{DUTY1}$ is smaller than the current $I_{DUTY2}$. After the driving device is power up, $I_{DUTY1}$ is firstly provided, if the voltage $V_{DUTY}$ is smaller than the lower limit threshold voltage $V_{TH_MIN}$, then $I_{DUTY2}$ is provided. Persons of ordinary skills in the art will recognize that this is not confined to the scope of the invention. After the driving device is power up, it may be that $I_{DUTY2}$ is firstly provided, if the voltage $V_{DUTY}$ is greater than the upper limit threshold voltage $V_{TH_MAX}$, then $I_{DUTY2}$ is provided. These transformations are easily understood by persons of ordinary skills in the art, so it does not surpass the scope of the invention.

While specific embodiments of the present invention have been provided, it is to be understood that these embodiments are for illustration purposes and not limiting. Since the invention can be practiced in various forms without distracting the spirit or the substance of the invention, it should be understood that the above embodiments are not confined to any aforementioned specific detail, but should be explanatory broadly within the spirit and scope limited by the appended claims. Thus, all the variations and modification falling into the scope of the claims and their equivalents should be covered by the appended claims.

What is claimed is:

1. A dimming method for a light-emitting element driving device, wherein the light-emitting driving device comprises a dimming resistor configured for dimming depth and a power converter coupled to a plurality of light-emitting elements, the dimming method comprising:

providing a first current to the dimming resistor;

comparing a voltage across the dimming resistor with a first threshold voltage;

providing a second current to the dimming resistor based on a comparison result of the voltage across the dimming resistor with the first threshold voltage;

generating a dimming signal based on the voltage across the dimming resistor and a current flowing through the dimming resistor; and controlling the power converter based on the dimming signal to regulate an illuminance of the plurality of light-emitting elements;

wherein:

the first current is set to be smaller than the second current, and the second current is provided to the dimming resistor if the voltage across the dimming resistor is smaller than the first threshold voltage; or the first current is set to be larger than the second current, and the second current is provided to the dimming resistor if the voltage across the dimming resistor is larger than the first threshold voltage.

2. The dimming method of claim 1, wherein the step of generating the dimming signal comprises:

configuring a plurality of voltage windows for the voltage across the dimming resistor; and generating the dimming signal based on which voltage window the voltage across the dimming resistor falls into, and the current flowing through the dimming resistor.

3. The dimming method of claim 1, wherein the step of generating the dimming signal comprises:

generating a digital threshold signal based on the voltage across the dimming resistor; and comparing the digital threshold signal with a periodic digital counting signal to generate the dimming signal.

4. The dimming method of claim 1, wherein the step of controlling the power converter based on the dimming signal comprises:

providing a driving current from the power converter to drive the plurality of light-emitting elements when the dimming signal is at a first state; and ceasing to provide the driving current from the power converter to cease driving the plurality of light-emitting elements when the dimming signal is at a second state.

5. The dimming method of claim 1, wherein the light-emitting element driving device further receives a dimming control signal, the dimming method further comprising:

configuring a dimming duty cycle of the dimming signal as 100% when the dimming control signal is at a first state; and determining the dimming duty cycle of the dimming signal based on the voltage across the dimming resistor and the current flowing through the dimming resistor when the dimming control signal is at a second state.

6. The dimming method of claim 1, wherein the light-emitting element driving device further receives a multi-functional signal, the dimming method further comprising:

determining whether a 2-step dimming function is activated or deactivated; wherein if the 2-step dimming function is activated, then:

configuring the dimming duty cycle of the dimming signal as 100% when the multi-functional signal is at a first state; and determining the dimming duty cycle of the dimming signal based on the voltage across the dimming resistor and the current flowing through the dimming resistor when the multi-functional signal is at a second state; and wherein if the 2-step dimming function is deactivated, then:

providing a driving current from the power converter to drive the plurality of light-emitting elements when the multi-functional signal is at a first state; and ceasing to provide the driving current from the power converter to cease driving the plurality of light-emitting elements when the multi-functional signal is at a second state.

7. The dimming method of claim 6, wherein, the 2-step dimming function is determined to be deactivated when the voltage across the dimming resistor is greater than a second threshold voltage with the second current provided to the dimming resistor.

8. A controller fora light-emitting element driving device, the controller comprising a first pin coupled to a dimming resistor, wherein:

the controller provides a first current to the first pin, and compares a voltage at the first pin with a first threshold voltage;

the controller provides a second current to the first pin based on a comparison result of the voltage at the first pin with the first threshold voltage; and the controller generates a dimming signal based on the voltage at the first pin and a current flowing through the first pin, and controls a power converter based on the dimming signal to regulate an illuminance of a plurality of light-emitting elements;

and wherein the controller further comprises:

a variable current source, coupled to the first pin;

a dimming sensing circuit, coupled to the first pin, configured to receive the voltage at the first pin and to generate the dimming signal based on the voltage at the first pin; and a control circuit, coupled to the dimming sensing circuit, configured to generate a control signal based on the dimming signal to control the power converter.

9. The controller of claim 8, wherein the first current is smaller than the second current, and the second current is provided to the first pin if the voltage at the first pin is smaller than the first threshold voltage.

10. The controller of claim 8, wherein, a plurality of voltage windows for the voltage at the first pin are configured, and the controller generates the dimming signal based on which voltage window the voltage at the first pin falls into and the current flowing through the first pin.

11. The controller of claim 8, wherein, a digital threshold signal is generated based on the voltage at the first pin, and the digital threshold signal is compared with a periodic digital counting signal to generate the dimming signal.

12. The controller of claim 8, wherein:

a driving current is provided from the power converter to drive the plurality of light-emitting elements when the dimming signal is at a first state; and no driving current is provided from the power converter to drive the plurality of light-emitting elements when the dimming signal is at a second state.

13. The controller of claim 8, further receiving a dimming control signal, wherein:

a dimming duty cycle of the dimming signal is configured as 100% when the dimming control signal is at a first state; and the dimming duty cycle of the dimming signal is determined based on the voltage at the first pin and the current flowing through the first pin when the dimming control signal is at a second state.

14. The controller of claim 8, further comprising a second pin receiving a multi-functional signal, and determining whether a 2-step dimming function is activated or deactivated, wherein:

if the 2-step dimming function is activated, then:

the dimming duty cycle of the dimming signal is configured as 100% when the multi-functional signal is at a first state; and the dimming duty cycle of the dimming signal is determined based on the voltage at the first pin and the current flowing through the first pin when the multi-functional signal is at a second state; and wherein if the 2-step dimming function is deactivated, then:

a driving current is provided from the power converter to drive the plurality of light-emitting elements when the multi-functional signal is at a first state; and no driving current is provided from the power converter to drive the plurality of light-emitting elements when the multi-functional signal is at a second state.

15. The controller of claim 14, wherein, the 2-step dimming function is determined to be deactivated when the voltage at the first pin is greater than a second threshold voltage with the second current provided to the first pin.

16. The controller of claim 8, further comparing the voltage at the first pin with a third threshold voltage greater than the first threshold voltage, wherein:

the first pin is determined to be open-circuited when the voltage at the first pin is greater than the third threshold voltage with the first current provided;

the first pin is determined to be short-circuited when the voltage at the first pin is smaller than the first threshold voltage with the second current provided.

17. A light-emitting element driving device comprising a controller, the controller comprising a first pin coupled to a dimming resistor, wherein:

the controller provides a first current to the first pin, and compares a voltage at the first pin with a first threshold voltage;

the controller provides a second current to the first pin based on a comparison result of the voltage at the first pin with the first threshold voltage; and the controller generates a dimming signal based on the voltage at the first pin and a current flowing through the first pin, and controls a power converter for the light-emitting elements based on the dimming signal to regulate an illuminance of a plurality of light-emitting elements;

and wherein the controller further comprises:

a variable current source, coupled to the first pin;

a dimming sensing circuit, coupled to the first pin, configured to receive the voltage at the first pin and to generate the dimming signal based on the voltage at the first pin; and a control circuit, coupled to the dimming sensing circuit, configured to generate a control signal based on the dimming signal to control the power converter.

18. The light-emitting element driving device of claim 17, wherein the first current is smaller than the second current, and the second current is provided to the first pin if the voltage at the first pin is smaller than the first threshold voltage.

19. The light-emitting element driving device of claim 17, wherein, a plurality of voltage windows for the voltage at the first pin are configured, and the controller generates the dimming signal based on which voltage window the voltage at the first pin falls into and the current flowing through the first pin.

20. The light-emitting element driving device of claim 17, wherein, a digital threshold signal is generated based on the voltage at the first pin, and the digital threshold signal is compared with a periodic digital counting signal to generate the dimming signal.

21. The light-emitting element driving device of claim 17, wherein:

a driving current is provided from the power converter to drive the plurality of light-emitting elements when the dimming signal is at a first state; and no driving current is provided from the power converter to drive the plurality of light-emitting elements when the dimming signal is at a second state.

22. The light-emitting element driving device of claim 17, the controller further receiving a dimming control signal, wherein:

a dimming duty cycle of the dimming signal is configured as 100% when the dimming control signal is at a first state; and the dimming duty cycle of the dimming signal is determined based on the voltage at the first pin and the current flowing through the first pin when the dimming control signal is at a second state.

23. The light-emitting element driving device of claim 17, the controller further comprising a second pin receiving a multi-functional signal, and determining whether a 2-step dimming function is activated or deactivated, wherein:

if the 2-step dimming function is activated, then:

the dimming duty cycle of the dimming signal is configured as 100% when the multi-functional signal is at a first state; and the dimming duty cycle of the dimming signal is determined based on the voltage at the first pin and the current flowing through the first pin when the multi-functional signal is at a second state; and wherein if the 2-step dimming function is deactivated, then:

a driving current is provided from the power converter to drive the plurality of light-emitting elements when the multi-functional signal is at a first state; and no driving current is provided from the power converter to drive the plurality of light-emitting elements when the multi-functional signal is at a second state.

24. The light-emitting element driving device of claim 23, wherein, the 2-step dimming function is determined to be deactivated when the voltage at the first pin is greater than a second threshold voltage with the second current provided to the first pin.

25. The light-emitting element driving device of claim 17, the controller comparing the voltage at the first pin with a third threshold voltage greater than the first threshold voltage, wherein:

the first pin is determined to be open-circuited when the voltage at the first pin is greater than the third threshold voltage with the first current provided;

the first pin is determined to be short-circuited when the voltage at the first pin is smaller than the first threshold voltage with the second current provided.

* * * * *